US006675887B2

(12) United States Patent
Garner et al.

(10) Patent No.: US 6,675,887 B2
(45) Date of Patent: Jan. 13, 2004

(54) MULTIPLE TEMPERATURE SENSITIVE DEVICES USING TWO HEAT PIPES

(75) Inventors: Scott D. Garner, Lititz, PA (US); G. Yale Eastman, Lancaster, PA (US)

(73) Assignee: Thermal Corp., Stanton, DE (US)

( * ) Notice: Subject to any disclaimer, the term of this patent is extended or adjusted under 35 U.S.C. 154(b) by 92 days.

(21) Appl. No.: 10/106,277

(22) Filed: Mar. 26, 2002

(65) Prior Publication Data

US 2003/0183381 A1 Oct. 2, 2003

(51) Int. Cl.[7] ..... F28F 27/00

(52) U.S. Cl. ..... 165/274; 165/104.14; 165/104.27

(58) Field of Search ..... 165/104.14, 104.21, 165/104.26, 104.27, 104.33, 104.32, 274; 361/700; 257/714, 715

(56) References Cited

U.S. PATENT DOCUMENTS

| | | | | |
|---|---|---|---|---|
| 3,613,773 A | | 10/1971 | Hall et al. | 165/32 |
| 3,782,449 A | | 1/1974 | Busse et al. | 165/32 |
| 3,933,198 A | | 1/1976 | Hara et al. | 165/32 |
| 3,958,627 A | | 5/1976 | Edelstein | 165/32 |
| 4,033,406 A | | 7/1977 | Basiulis | 165/32 |
| 4,067,237 A | | 1/1978 | Arcella | 73/204 |
| 4,387,762 A | | 6/1983 | Rinderle | |
| 4,799,537 A | | 1/1989 | Hoke, Jr. | 165/32 |
| 4,917,178 A | | 4/1990 | Kosson et al. | 165/111 |
| 5,044,426 A | | 9/1991 | Kneidel | 165/32 |
| 5,289,869 A | | 3/1994 | Klein et al. | 165/273 |
| 5,579,830 A | * | 12/1996 | Giammaruti | 165/104.07 |
| 5,591,162 A | | 1/1997 | Fletcher et al. | 606/25 |
| 5,771,967 A | | 6/1998 | Hyman | 165/274 |
| 6,062,299 A | * | 5/2000 | Choo et al. | 165/104.33 |
| 6,104,611 A | | 8/2000 | Glover et al. | 361/700 |
| 6,230,790 B1 | | 5/2001 | Hemingway et al. | 165/80.4 |

FOREIGN PATENT DOCUMENTS

| | | | | |
|---|---|---|---|---|
| JP | 0092641 | * | 9/1974 | 165/104.27 |
| JP | 0111551 | * | 9/1978 | 165/104.14 |
| JP | 0250491 | * | 11/1986 | 165/104.14 |
| JP | 404151495 | * | 5/1992 | 165/104.14 |

* cited by examiner

*Primary Examiner*—Christopher Atkinson
(74) *Attorney, Agent, or Firm*—Duane Morris LLP

(57) ABSTRACT

A heat pipe assembly comprises a first heat pipe having a condenser and a working fluid. A reservoir communicates with the condenser of the first heat pipe and contains a non-condensable gas which variably permits access of the working fluid to the condenser of the first heat pipe, depending on a pressure of the working fluid. A second heat pipe has an evaporator. At least a portion of the evaporator of the second heat pipe is contained inside of the condenser of the first heat pipe.

8 Claims, 5 Drawing Sheets

MULTIPLE TEMPERATURE SENSITIVE DEVICES USING TWO HEAT PIPES

BACKGROUND OF THE INVENTION

1. Field of the Invention

The present invention relates generally to heat transfer devices and, more particularly, to variable conductance heat pipes.

2. Description of Related Art

The reliability of electronic components decreases significantly as a result of high temperature extremes or large temperature swings, especially in circumstances where these swings or cycles are frequent. Causes of these temperature cycles include, for example, electronic loading or environmental temperature differences.

A heat pipe is a widely used device for transferring high rates of heat flow across large distances with negligible temperature drop. It generally includes a closed pressure vessel containing a working fluid (liquid and vapor) in saturated thermal equilibrium. External heat from a heat generating source is input to an evaporator section, and heat is rejected to and dissipated by an external heat sink from a condenser section. The evaporator section and condenser section are connected by a vapor flow volume and an internal capillary wick. A working fluid, such as ammonia, evaporates in the evaporator section, and the vapor flows to the condenser section and condenses, giving up its heat of vaporization to the heat pipe wall. The working fluid then returns in liquid form to the evaporator section via capillary pumping action within the wick.

The conventional heat pipe is effective in transferring a large amount of heat where a temperature difference between two places is small, but such a heat pipe can not execute a temperature control function. A Variable Conductance Heat Pipe (VCHP) is a device which provides better temperature control, i.e., maintains a heat source at a stable temperature within a few degrees of a set point, in situations where, for example, electronics equipment can either dissipate at different power levels, or the condenser or heat sink is to varying environmental temperatures. With a VCHP, the amount of heat transferred is usually controlled by blocking part of the condenser area with a non-condensable gas. The non-condensable gas, which is stored in a gas reservoir fluidly connected to the condenser of the VCHP, displaces a controlled portion of the working fluid vapor in the condenser, rendering that portion of the condenser containing the non-condensable gas thermally inactive by blocking the interior condenser surface. Heat transfer is inhibited because the working fluid vapor must diffuse through the non-condensable gas in order to reach the condenser surface. Increasing condenser blockage effectively closes the heat pipe, reducing the area available for heat transfer. As the heat load from a heat generating source is increased, the vapor pressure of the working fluid increases causing the non-condensable gas to compress and expose more of the condenser area, resulting in a passively controlled heat transfer device.

Not only does a VCHP work to maintain a relatively constant temperature despite varying heat input from heat generating sources at the evaporator end of the VCHP, but it also is effective at maintaining the heat generating source at a relatively constant temperature where there is great variation in heat sink temperature due to varying environmental conditions.

FIG. 5 shows a typical prior art variable conductance heat pipe 400 having an evaporator end 405 and a condenser end 410. The VCHP 400 comprises a hollow envelope 420, a wick 430 a working fluid (not shown), a gas reservoir 440 containing a non-condensable gas 442, and fins 450. A heat generating source, such as an electronic device 300 is in thermal contact with the evaporator end 405 of the VCHP 400.

The sensitivity or control level of the VCHP 300 is driven by the ratio of reservoir volume to condenser volume. As shown in FIG. 5, in a typical VCHP, the gas front range 444 must swing over a relatively large distance to block or expose the entire condenser area and transfer heat to all of the fins 450. This results in the requirement of a large volume reservoir to achieve a certain desired level of control.

An improved VHCP is desired.

SUMMARY OF THE INVENTION

The present invention is a heat pipe assembly comprising a first heat pipe having a condenser and a working fluid. A reservoir contains a non-condensable gas which variably permits access of the working fluid to the condenser of the first heat pipe, depending on a pressure of the working fluid. A second heat pipe has an evaporator that is in thermal contact with the first heat pipe.

Figure 1:
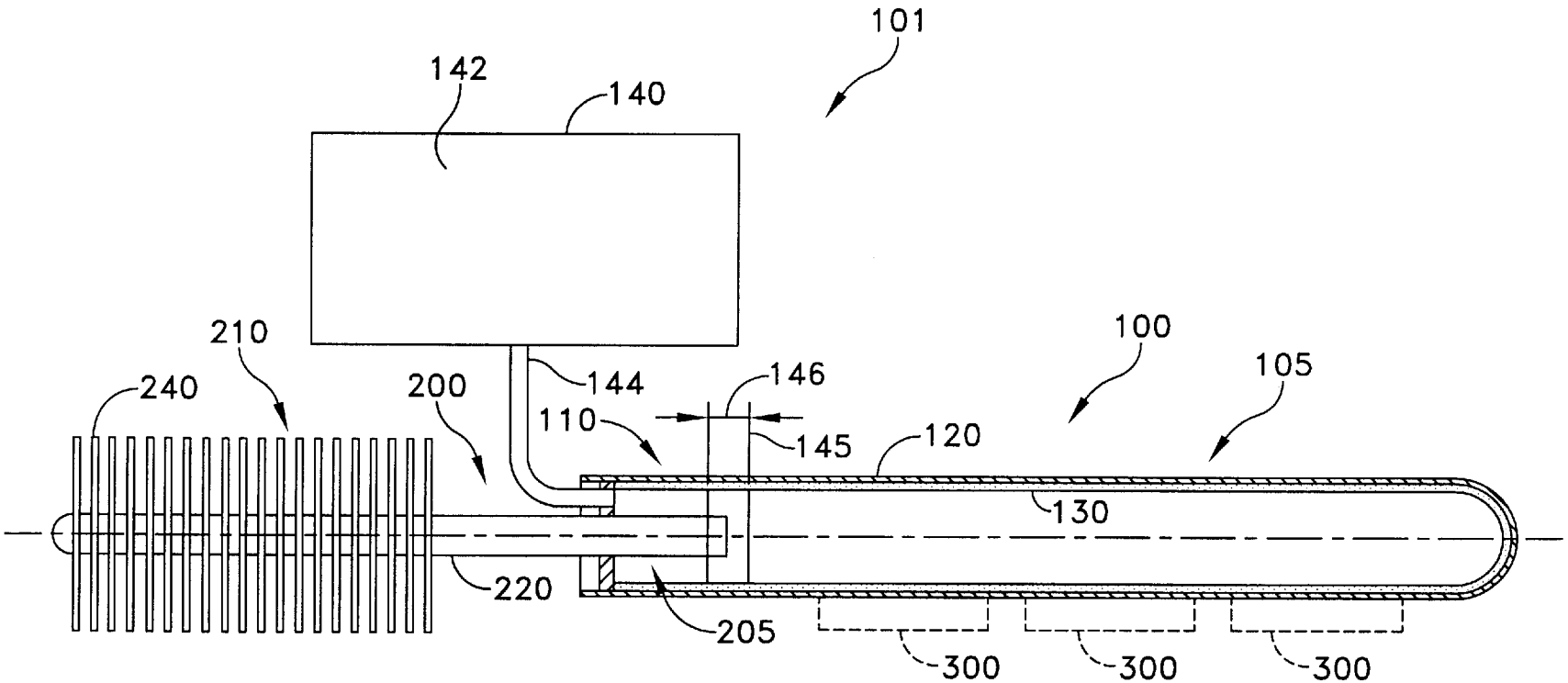
FIG. 1 is a cross-sectional view of a heat pipe assembly of the present invention.

It will be understood that the drawings are not scale drawings. One of ordinary skill in the art can readily select appropriate dimensions for a specific cooling application.

DETAILED DESCRIPTION OF THE PREFERRED EMBODIMENT

In the description below, the terms top, bottom, left and right are understood to refer to the directions appropriate when the device is oriented in the manner shown in the figures. Such terms do not limit the possible orientations of the device, and it is understood that the device can be oriented in any manner, and such relational terms as top, bottom, left and right would automatically be changed.

In the various drawings, parts identified by the same reference numeral are the same.

Referring to FIG. 1, a heat pipe assembly 101 according to one embodiment of the invention comprises a variable conductance heat pipe (VCHP) 100 and a second heat pipe 200. The exemplary second heat pipe 200 provides an extremely stiff heat sink or condenser area of the first heat pipe 100. This provides significant improvement in the temperature control of the first VHCP 100.

VCHP 100 has an evaporator end 105 and a condenser end 110. VCHP includes a hollow envelope 120, a wick 130, a working fluid (not shown) and a gas reservoir 140, which may be external to the VHCP (as shown in FIG. 1) or integral (as shown by 540 in FIG. 4). Gas reservoir 140 contains non-condensable gas 142. Envelope 120 is typically comprised of a metal such as copper or aluminum, and is typically selected based on compatibility with the selected working fluid. The structure and composition of wick 130 may vary depending on the application and may include such structures known to those of ordinary skill in the art such as groove, screen, cable/fiber, or sintered powder metal. Likewise, the working fluid may vary depending on the application and temperature range, and may include water, ammonia or freon, for example. Suitable non-condensable gases 142 include inert gases such as nitrogen, argon, helium, neon and mixtures thereof.

Figure 2:
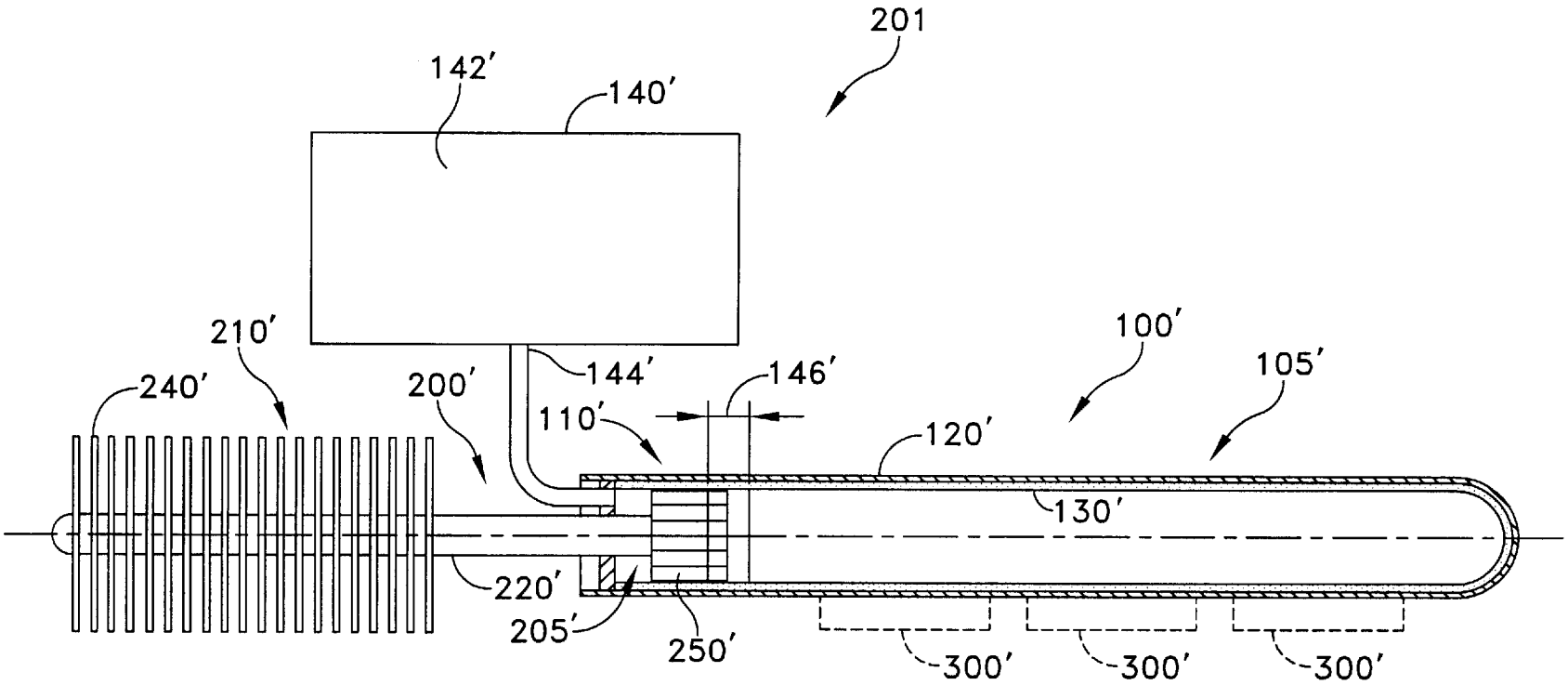
FIG. 2 is a cross-sectional view of a variation of the heat pipe assembly of FIG. 1.
Figure 3:
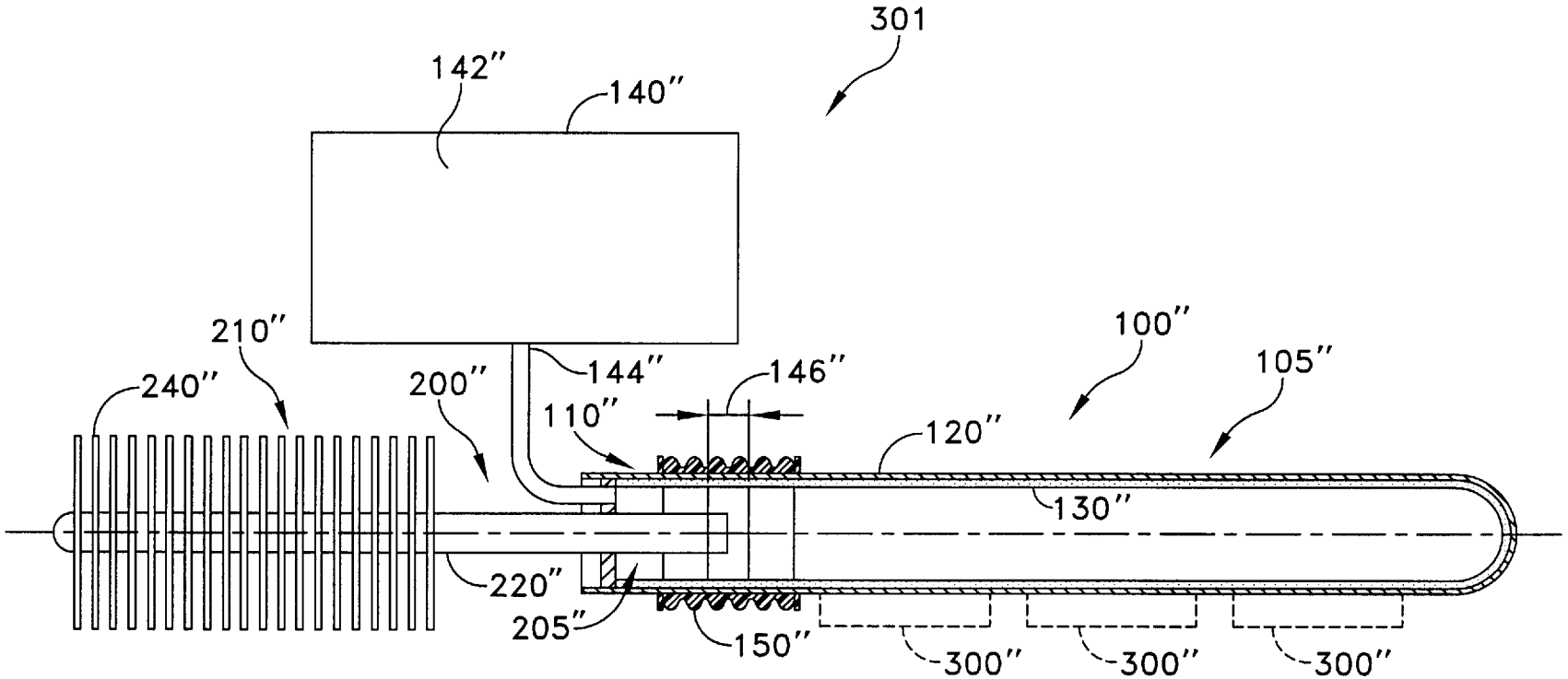
FIG. 3 is a cross-sectional view of a another embodiment of the heat pipe assembly of the present invention.

In the exemplary embodiment of FIG. 1, fins are not included on the condenser 110 of the first heat pipe 100. Rather, heat from the first heat pipe is dissipated to the environment by way of the second heat pipe 200. Second heat pipe 200 has an evaporator end 205 and a condenser end 210. Second heat pipe 200 comprises a hollow envelope 220, a wick (not shown) and a working fluid (not shown). Second heat pipe 200 may further include a heat sink 240 attached to condenser end 210. Heat sink 240 may be in the form of fins as shown in FIGS. 1–3. Second heat pipe 200 may be a conventional heat pipe or alternatively, second heat pipe 200 may itself be a variable conductance heat pipe.

Envelope 220, like envelope 120, is typically comprised of a metal such as copper or aluminum. The structure and composition of the wick of the second heat pipe 200 and the composition of the working fluid, again, may vary depending on the application and may include any structure or composition known to those of ordinary skill in the art. Preferably, the envelope of second heat pipe 200 is made of the same material as the envelope of first heat pipe 100, and the working fluids are the same.

The exemplary assembly of FIG. 1 is assembled in the following manner. As shown in FIG. 1, wick 130 of VCHP 100 lines an inside surface of envelope 120. The envelope 120 is evacuated. A sufficient amount of the working fluid (in liquid form) is added so as to saturate the wick 130. When the working fluid reaches thermal equilibrium, the working fluid (in liquid and gas states) substantially fills envelope 120. Gas reservoir 140 is mechanically and fluidly connected to the condenser end 110 of VCHP 100 via tubing 144. Non-condensable gas 142 is variably contained within the gas reservoir 140, tubing 144 and condenser end 110 of VCHP 100.

Evaporator end 205 of second heat pipe 200 is mechanically attached and sealed to condenser end 110 of VCHP and at least a portion of evaporator end 205 of second heat pipe 200 is contained inside of condenser end 110 of VCHP 100. Evaporator end 205 of second heat pipe 200 could be in thermal contact with the condenser end 110 of VCHP 100. Preferably, heat sink 240 or a plurality of individual fins are attached to an outside surface of envelope 210 of second heat pipe 200.

The embodiment of FIG. 1 operates in the following manner. In the embodiment of FIG. 1, an outside surface of the envelope 120 at the evaporator end 105 of VCHP 100 is in thermal contact with an external heat generating source or sources, such as electronic devices 300. At a low end of the operating temperature range (at low operating power for electronics devices), the gas charge in the gas reservoir 140 is at such a pressure that the gas blankets the condenser end 110 of the VCHP 100.

A variable gas front 145 marks the separation point between the working fluid vapor and the non-condensable gas 142. The non-condensable gas 142 has a moving front 145 with a range of motion 146 within the condenser 110 of the first heat pipe 100. The non-condensable gas 142 variably permits access of the working fluid to the condenser 110 and evaporator 205. When the moving front 145 is at a first (right in FIG. 1) boundary of the range of motion 146, the working fluid does not access a portion of the condenser 110 in which the evaporator 205 of the second heat pipe 200 is located. When the moving front 145 is at a second (left in FIG. 1) boundary of the range of motion 146, the working fluid accesses a portion of the condenser 110 in which the evaporator 205 of the second heat pipe 200 is located. When the gas front 145 moves to the towards the right in FIG. 1, the condensable gas front is to the right of the evaporator end 205 of heat pipe 200 and the blockage of the condenser end 110 by the non-condensable gas 142 prevents efficient heat transfer to condenser end 110 (and thus prevents heat transfer to the evaporator 205 of second heat pipe 200 and to heat sink 240). This allows the heat source(s) 300 to remain at a relatively constant temperature. As heat generated by the heat source(s) 300 heats the evaporator end 105 of VCHP 100, the working fluid is vaporized and the vapor begins to flow toward the condenser end 110 of VCHP 100, which is at a lower temperature. This vapor pressure causes the non-condensable gas to compress, and moves the gas front 145 further away from the evaporator end, thus exposing more of the condenser end (the "active condenser") to the hot working fluid vapor.

Figure 5:
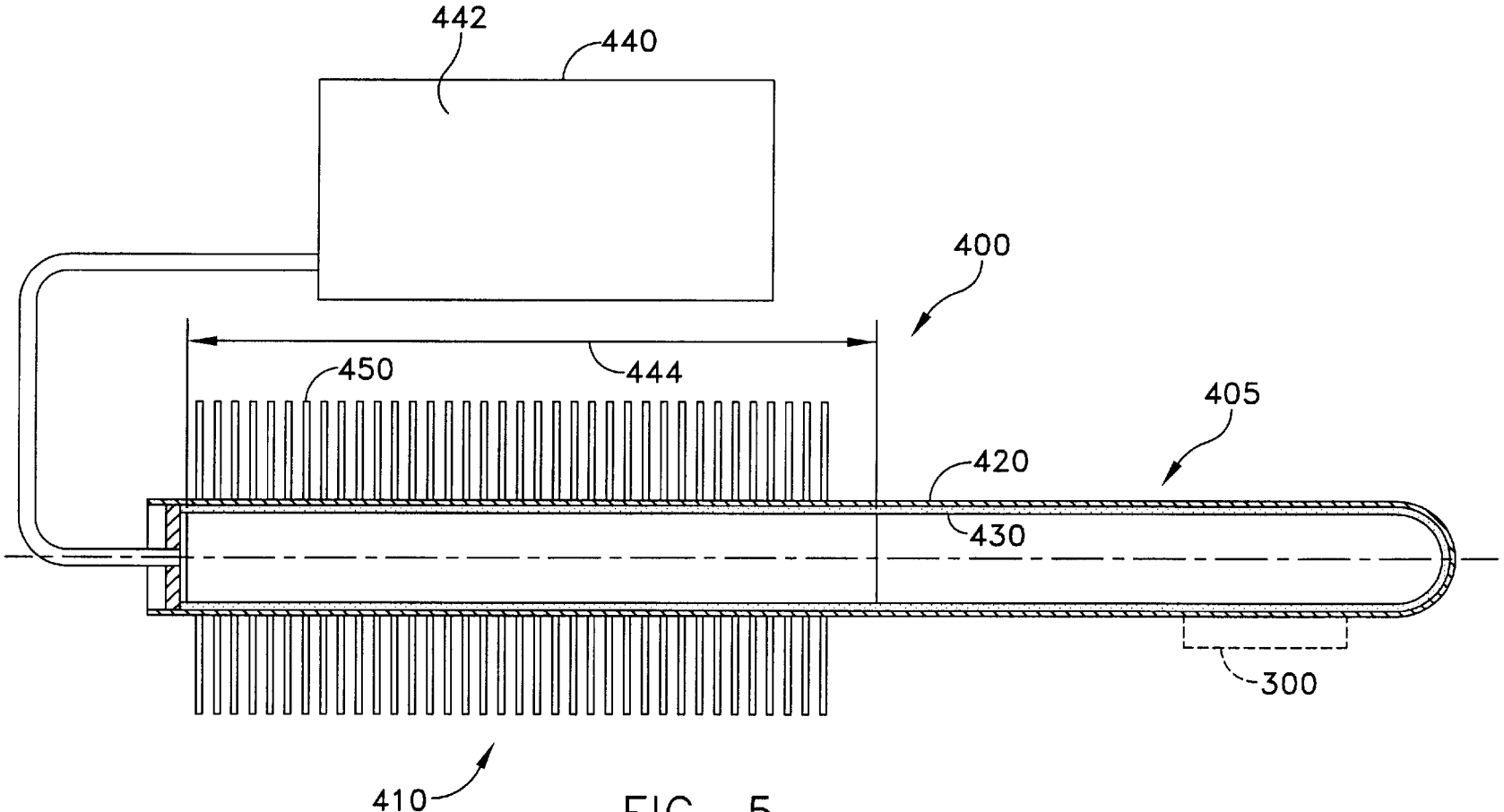
FIG. 5 (PRIOR ART)
FIG. 5 is a cross-sectional view of a prior art variable conductance heat pipe.

In prior art VCHP's, as shown in FIG. 5, the gas front range 444 must swing over a relatively large distance (i.e., the length of the finstack 450) to block or expose the entire condenser area. This results in the necessity of a large volume reservoir to achieve a given level of control. In the embodiment of FIG. 1, the incorporation of a second heat pipe 200 as the heat sink for the VCHP 100 allows the heat pipe assembly. 101 to absorb the entire heat load with very little surface area of condenser end 110 exposed to the condensing vapor.

In FIG. 1, the range of motion 146 is substantially shorter in the longitudinal direction than the condenser 110 of the first heat pipe 100, and substantially shorter in the longitudinal direction than the condenser 210 of the second heat pipe 200. For example, the range of motion may be less than 0.2 times as long as the condenser of the first heat pipe, or in some embodiments, between 0.07 and 0.2 times as long as the condenser of the first heat pipe. Similarly, the range of motion may be less than or equal to about 0.2 times as long as the condenser 210 of the second heat pipe 200, or the length of the finstack 240. This reduces the size of the reservoir and condenser area needed achieve the desired controlled heat transfer.

As soon as the gas front 145 touches the evaporator 205 of the second heat pipe 200, heat pipe 200 transfers the heat load to the heat sink 140, from which the heat is dissipated. This in turn decreases the vapor pressure of the evaporator end 105 of the VCHP 100 causing the gas front to move back towards the evaporator end 105. This expansion of the non-condensable gas 142 again blocks access to the condenser end 110 of VCHP 100 and second heat pipe 200. In this state almost no heat can be rejected and the pressure will begin to increase where the heat source is generating heat. With this improved heat pipe assembly, as shown in FIG. 1, the distance the gas front 145 must move (the "gas front range" 146), to go from "full on" to "full off" is very small compared to the prior art VCHP's as shown in FIG. 5, while still allowing the temperature of the heat source(s) to remain stable within a few degrees.

Referring to FIG. 2, there is shown a variation of the heat pipe assembly 201 containing a further improvement. Heat pipe assembly 201 includes a VCHP 100' and a second heat pipe 200'.

VCHP 100' in the variation of FIG. 2 is the same as VCHP 100 in FIG. 1. VCHP 100' has an evaporator end 105' and a condenser end 110'. VCHP 100' includes a hollow envelope 120', a wick 130', a working fluid (not shown) and a gas reservoir 140'. Gas reservoir 140' contains non-condensable gas 142'.

Second heat pipe 200' has an evaporator end 205' and a condenser end 210'. Second heat pipe 200' includes a hollow envelope 220', a wick (not shown), a working fluid (not shown) and evaporator fins 250. Second heat pipe 200' may further include a heat sink 240' attached to condenser end 210'. Such heat sink 240' may be in the form of fins as shown in FIGS. 1–3. Second heat pipe 200' may be a conventional heat pipe or alternatively, second heat pipe 200' may itself be a variable conductance heat pipe. Evaporator fins 250' are preferably comprised of metal such as aluminum, copper or steel.

In the embodiment as shown in FIG. 2, the distance from "full off" to "full on" is further reduced by the addition of conductive members, such as radial evaporator fins 250' to the evaporator end 205' of second heat pipe 200'. These conductive members 250' add surface area to the evaporator end 205' of second heat pipe 200' to further enhance heat transfer from the VCHP 100' to second heat pipe 200'. The result is an even more sensitive heat transfer device.

In the assembly 201 shown in FIG. 2 including the evaporator fins 250', evaporator fins 250' are mechanically and conductively coupled to evaporator end 205' of second heat pipe 200' to increase the evaporator surface area of (and heat transfer to) the evaporator end 205' of the second heat pipe 200' for enhancing heat transfer from VCHP 100' to the second heat pipe 200'. The evaporator fins 250' are contained within the condenser end 110' of the VCHP 100'.

Although the exemplary conductive members are fins 250', other shapes of conductive members may be used. For example, the conductive members may be radial columns or pins having a variety of shapes. Preferably, a shape that does not create significant resistance to movement of the vaporized working fluid is used.

Referring to FIG. 3, there is shown another embodiment of the heat pipe assembly 301 of the present invention containing a further improvement. Heat pipe assembly 301 includes a VCHP 100" and a second heat pipe 200".

VCHP 100" has an evaporator end 105" and a condenser end 110". VCHP 100" includes a hollow envelope 120", a wick 130", a working fluid (not shown) a gas reservoir 140", and an insulator 150". Gas reservoir 140" contains non-condensable gas 142". Insulator 150" is preferably comprised of a ceramic material, but may be comprised of any thermally insulating material, such as a low conductivity metal.

In the first heat pipe 100", the envelope 120" has a section 150" formed of a thermally insulating material at the condenser 110". Insulating section 150" provides continuity in the vapor seal of envelope 120", while substantially reducing or eliminating the conductive couplings between the evaporator end 105" of the envelope 120" and the evaporator 205" of second heat pipe 200". Wick 130" extends in the section between the thermally conductive portions of envelope 120", and abuts the inside surface of insulator 150". With an insulating section 150" in the envelope 120", heat transfer from the evaporator 105" to the evaporator 205" is essentially by way of the vaporized working fluid contacting the evaporator 205".

The second heat pipe 200" of FIG. 3 is the same as that shown in FIG. 1. Second heat pipe 200" has an evaporator end 205" and a condenser end 210". Second heat pipe 200" includes a hollow envelope 220", a wick 230", and a working fluid (not shown). Second heat pipe 200" may further include a heat sink 240" attached to condenser end 210". Heat sink 240" may be in the form of fins. Second heat pipe 200" may be a conventional heat pipe or alternatively, second heat pipe 200" may itself be a variable conductance heat pipe. The evaporator 205" of the second heat pipe 200" is located within the section formed of the thermally insulating material.

The heat pipe assembly 301 shown in FIG. 3 improves the control sensitivity of the heat exchange system. In a typical VCHP, as well as in the improved VCHP's of FIGS. 1 and 2, heat can be conducted from the metal envelope 120 at the evaporator end 105 of VCHP 100 to the condenser end 110 and to the evaporator of the second heat pipe 200. This conductive heat path decreases the control sensitivity of the system. In an ideal system, the two heat pipes would be completely thermally isolated except for heat transfer by condensing working fluid vapor from the VCHP to the evaporator of the second heat pipe. The incorporation of insulator 150" into the envelope 120" of VCHP 100" minimizes this alternative heat flow path, thus reducing any decrease in control sensitivity of the system.

Figure 4:
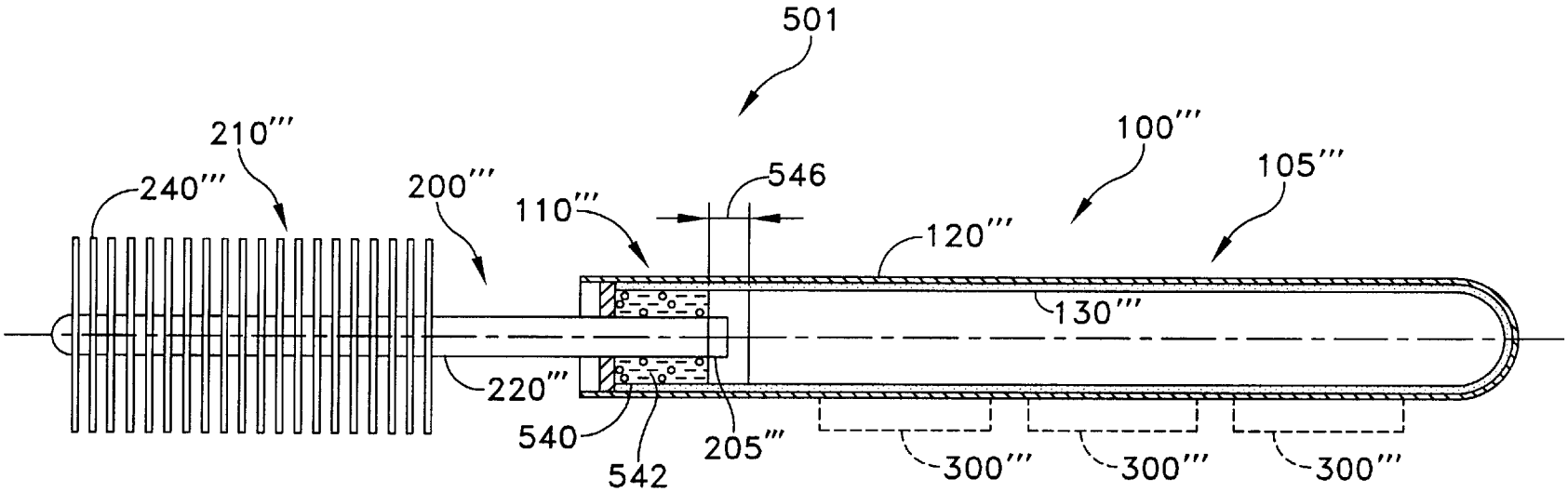
FIG. 4 is a cross sectional view of another variation of the heat pipe assembly of FIG. 1.

FIG. 4 shows another variation of the heat pipe assembly. In assembly 501, the reservoir 540 is completely internal to the first heat pipe 100'''. VCHP 100''' has an evaporator end 105''' and a condenser end 110''', a hollow envelope 120''', a wick 130''', and a working fluid (not shown). Gas reservoir 540 contains non-condensable gas 542. Second heat pipe 200''' has an evaporator end 205''', a condenser end 210''', a hollow envelope 220''', a heat sink 240''', a wick (not shown) and a working fluid (not shown).

The improved heat pipe assemblies 101, 201 or 301 of FIGS. 1–4 will be useful wherever temperature control of a device dissipating heat is desired. One application is for outdoor telecommunications equipment where the life of the electronic devices as well as their optimum performance can be improved by maintaining a relatively narrow operating temperature. Outdoor ambient temperatures can range from −45° C. to 50° C. Electronics cooled by traditional fixed conductance heat sinks will have a similarly large fluctuation in operating temperatures. Use of conventional VCHP's can shrink that range, and use of the improved heat pipe assemblies of the exemplary embodiments can shrink that range even further to an almost isothermal operating environment.

Another application for the heat pipe assemblies of FIGS. 1–4 is in situations where there are multiple heat sources or a single source with a varying heat load. With a fixed conductance heat sink the temperature will be linear with the amount of power dissipated. In order to have relatively fixed operating temperatures with varying loads requires an active feed back control to the heat sink. This active control might undesirably increase fan speed, liquid flow or compressor capacity in a refrigerated system.

The proposed system can be used to couple multiple devices to an over-capacity heat sink operating at a constant temperature. The device operating temperatures will be maintained at a relatively constant temperature regardless of how many devices are operating at a given time.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A heat pipe assembly comprising:

a first heat pipe having a condenser and a working fluid;

a reservoir containing a non-condensable gas which variably permits access of the working fluid to the condenser of the first heat pipe, depending on a pressure of the working fluid; and a second heat pipe having an evaporator that is in thermal contact with the first heat pipe.

2. The heat pipe assembly of claim 1, wherein:

the first heat pipe has a longitudinal direction;

the non-condensable gas has a moving front with a range of motion within the condenser of the first heat pipe;

when the moving front is at a first boundary of the range of motion, the working fluid does not access a portion of the condenser in which the evaporator of the second heat pipe is located; and when the moving front is at a second boundary of the range of motion, the working fluid accesses a portion of the condenser in which the evaporator of the second heat pipe is located.

3. The heat pipe assembly of claim 1, further comprising a heat sink or a plurality of fins attached to a condenser of the second heat pipe.

4. The heat pipe assembly of claim 3, wherein the first heat pipe has no heat sink or fins attached directly thereto.

5. The heat pipe assembly of claim 1, wherein at least a portion of the evaporator of the second heat pipe is contained inside of the condenser of the first heat pipe.

6. The heat pipe assembly of claim 1, wherein the reservoir is external to the first heat pipe, and communicates with the condenser of the first heat pipe.

7. The heat pipe assembly of claim 1, further comprising an insulator that reduces heat transfer between an envelope of the first heat pipe and an envelope of the second heat pipe.

8. The heat pipe assembly of claim 7, wherein the insulator is ceramic.

* * * * *